US010658787B2

(12) United States Patent
An et al.

(10) Patent No.: US 10,658,787 B2
(45) Date of Patent: May 19, 2020

(54) COAXIAL CABLE AND CONNECTOR ASSEMBLY WITH PRE-MOLDED PROTECTIVE BOOT

(71) Applicant: CommScope Technologies LLC, Hickory, NC (US)

(72) Inventors: Hongjuan An, Jiangsu (CN); Yujun Zhang, Jiangsu (CN); Jin Liu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/273,306

(22) Filed: Feb. 12, 2019

(65) Prior Publication Data

US 2019/0296479 A1 Sep. 26, 2019

(51) Int. Cl.

| | |
|---|---|
| ***H01R 13/52*** | (2006.01) |
| ***H01R 24/42*** | (2011.01) |
| ***H01R 13/187*** | (2006.01) |
| ***H01R 9/05*** | (2006.01) |
| *H01R 103/00* | (2006.01) |

(52) U.S. Cl.

CPC ..... *H01R 13/5205* (2013.01); *H01R 9/05* (2013.01); *H01R 13/187* (2013.01); *H01R 13/5213* (2013.01); *H01R 24/42* (2013.01); *H01R 2103/00* (2013.01)

(58) Field of Classification Search

CPC .... H01R 13/5205; H01R 9/05; H01R 13/187; H01R 13/5213

USPC ..... 439/578, 584, 445, 476.1

See application file for complete search history.

(56) References Cited

U.S. PATENT DOCUMENTS

| | | | | |
|---|---|---|---|---|
| 2,449,983 A * | 9/1948 | Devol | H01R 24/542 | 174/88 C |
| 3,668,612 A * | 6/1972 | Nepovim | H01R 9/05 | 439/584 |
| 3,854,789 A * | 12/1974 | Kaplan | H01R 9/0521 | 439/584 |
| 4,135,776 A * | 1/1979 | Ailawadhi | H01R 9/0521 | 439/583 |

(Continued)

OTHER PUBLICATIONS

International Search Report and Written Opinion corresponding to International Application No. PCT/US2019/019357 dated Jun. 12, 2019.

*Primary Examiner* — Tulsidas C Patel
*Assistant Examiner* — Peter G Leigh
(74) *Attorney, Agent, or Firm* — Myers Bigel, P.A.

(57) ABSTRACT

An assembly includes: a coaxial cable; a coaxial connector having an inner contact and an outer conductor body, the outer conductor body having a rear portion electrically connected with the outer conductor of the coaxial cable to form a joint; and a protective boot that overlies a forward portion of the coaxial cable and the rear portion of the outer conductor body to protect the joint between the coaxial cable and the connector. The boot comprises a body with a bore extending therethrough and includes a cable sealing section at one end that interference fits with the jacket of the cable to provide sufficient support for coaxial cable and creates a first seal with the jacket of the cable. The boot further including a feature within the bore that engages the outer conductor body forward of the electrical connection between the outer conductor and the outer conductor body.

19 Claims, 6 Drawing Sheets

(56) References Cited

U.S. PATENT DOCUMENTS 4,444,453 A * 4/1984 Kirby ..... H01R 9/0521 439/583
5,284,449 A * 2/1994 Vaccaro ..... H01B 3/441 439/583
5,795,188 A * 8/1998 Harwath ..... H01R 9/0524 439/583
6,027,373 A * 2/2000 Gray ..... H01R 4/489 174/74 R
6,840,803 B2 * 1/2005 Wlos ..... H01R 9/0518 439/578
7,097,500 B2 * 8/2006 Montena ..... H01R 9/05 439/587
7,118,416 B2 * 10/2006 Montena ..... H01R 13/5205 439/584
7,186,127 B2 * 3/2007 Montena ..... H01R 9/05 439/277
7,189,115 B1 * 3/2007 Montena ..... H01R 9/0524 439/584
7,357,671 B2 * 4/2008 Wild ..... H01R 9/0521 439/583
7,500,874 B2 * 3/2009 Montena ..... H01R 4/70 439/587
8,435,073 B2 * 5/2013 Wild ..... H01R 24/564 439/578
8,453,320 B2 * 6/2013 Van Swearingen .... B23K 20/10 29/828
8,853,542 B2 * 10/2014 Anderson ..... H01R 13/5213 174/138 F
9,172,156 B2 * 10/2015 Nugent ..... H01R 9/0518
9,276,363 B2 * 3/2016 Wild ..... H01R 24/564
9,312,609 B2 * 4/2016 Wild ..... H01R 4/029
9,384,872 B2 * 7/2016 Wild ..... H01R 4/029
9,450,329 B2 * 9/2016 Haberek ..... H01R 13/5219
9,633,765 B2 * 4/2017 Natoli ..... H01R 4/029
2004/0102089 A1 5/2004 Chee
2007/0123101 A1 * 5/2007 Palinkas ..... H01R 9/0521 439/579
2011/0059650 A1 * 3/2011 Amidon ..... H01R 13/623 439/584
2013/0157494 A1 6/2013 Lim
2014/0045357 A1 * 2/2014 Nugent ..... H01R 13/5221 439/275
2014/0113486 A1 4/2014 Wild et al.
2015/0064952 A1 3/2015 Vaccaro
2015/0236458 A1 8/2015 Zimmerhaeckel et al.

* cited by examiner

COAXIAL CABLE AND CONNECTOR ASSEMBLY WITH PRE-MOLDED PROTECTIVE BOOT

RELATED APPLICATION

The present application claims priority from and the benefit of Chinese Patent Application No. 201810227418.4, filed Mar. 20, 2018, the disclosure of which is hereby incorporated herein by reference in its entirety.

FIELD OF THE INVENTION

The present invention is directed generally to electrical cable connectors, and more particularly to coaxial connectors for electrical cable.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic apparatus or on another cable. Typically, one connector will include a structure such as a pin or post connected to an inner conductor of the coaxial cable and an outer conductor connector body connected to the outer conductor of the coaxial cable these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Care should be taken to protect the joint between the coaxial cable and the connector. In many instances the jacket of the cable is stripped away from the forward end of the cable to enable joining of the connector and the cable, which can expose portions of the connector and the cable. One solution for protecting this joint employs an overbody that is molded over portions of the connector and the cable after termination. An overbody may increase cable-to-connector torsion and pull resistance. However, overmolding can require additional equipment/steps/labor, which raises costs, and can negatively impact performance. Another solution for protecting this joint employs a heat shrink tube that is shrunk over portions of the coaxial cable and the connector after heating. This technique also requires investment in heating equipment and extensive labor.

SUMMARY

As a first aspect, embodiments of the invention are directed to an assembly, comprising: a coaxial cable having an inner conductor, an outer conductor circumferentially surrounding and electrically insulated from the inner conductor, and a jacket overlying the outer conductor; a coaxial connector having an inner contact and an outer conductor body circumferentially surrounding and electrically insulated from the inner contact, the outer conductor body having a rear portion electrically connected with the outer conductor of the coaxial cable to form a joint; and a protective boot that overlies a forward portion of the coaxial cable and the rear portion of the outer conductor body to protect the joint, the boot comprising a body with a bore extending therethrough, the body including a cable sealing section at one end that may form an interference fit with the jacket of the cable to provide sufficient support for coaxial cable and create a first seal with the jacket of the cable, the boot further including one or more features within the bore that engage the outer conductor body forward of the electrical connection between the outer conductor and the outer conductor body to prevent axial movement of the boot relative to the cable and connector after installation of the boot.

As a second aspect, embodiments of the invention are directed to a method of forming an assembly, comprising:

(a) providing a coaxial cable having an inner conductor, an outer conductor circumferentially surrounding and electrically insulated from the inner conductor, and a jacket overlying the outer conductor;

(b) installing a protective boot on the coaxial cable, the boot having a body with a bore extending therethrough, the body including a cable sealing section at one end that forms an interference fit with the jacket of the cable to provide sufficient support for coaxial cable and/or create a first seal with the jacket of the cable;

(c) terminating the cable with a coaxial connector, the coaxial connector having an inner contact and an outer conductor body circumferentially surrounding and electrically insulated from the inner contact, the outer conductor body having a rear portion electrically connected with the outer conductor of the coaxial cable to form a joint; and (d) sliding the boot along the cable to overlie a rear portion of the outer conductor body, the boot further including one or more features within the bore that engage the outer conductor body forward of the electrical connection between the outer conductor and the outer conductor body to secure the boot on the outer conductor body and prevent axial movement of the boot relative to the cable and connector after installation of the boot.

DETAILED DESCRIPTION

Figure 1:
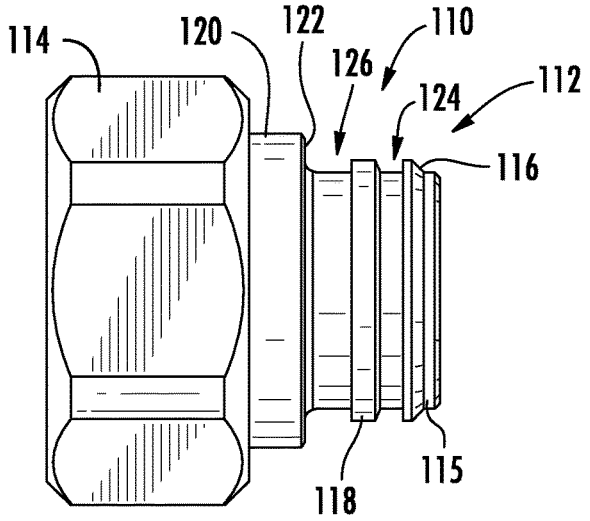
FIG. 1 is a side view of an exemplary connector for use in an assembly according to embodiments of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Also, as used herein, the terms "horizontal" and "vertical" are intended to encompass structures that may vary from precise horizontal or vertical orientations by a small amount (e.g., 5-10 degrees).

Figure 2:
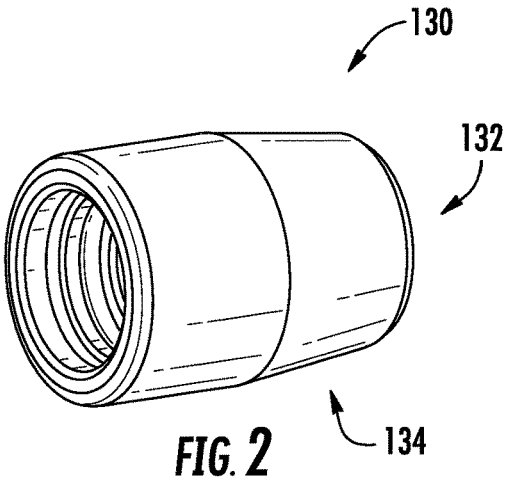
FIG. 2 is a perspective view of a protective boot for use in an assembly according to embodiments of the invention.
Figure 3:
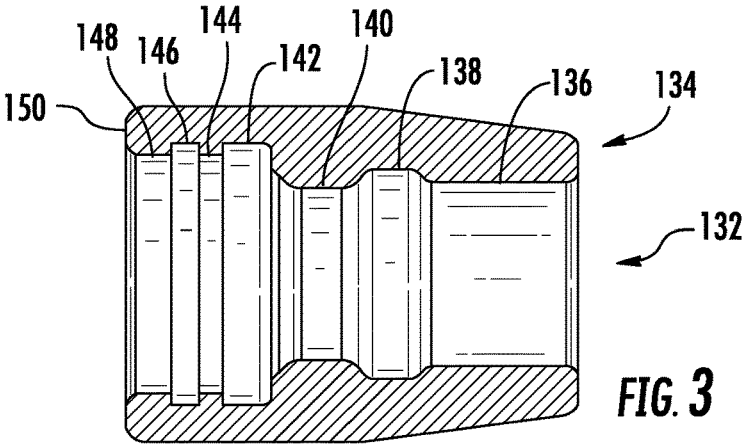
FIG. 3 is a section view of the boot of FIG. 2.
Figure 4:
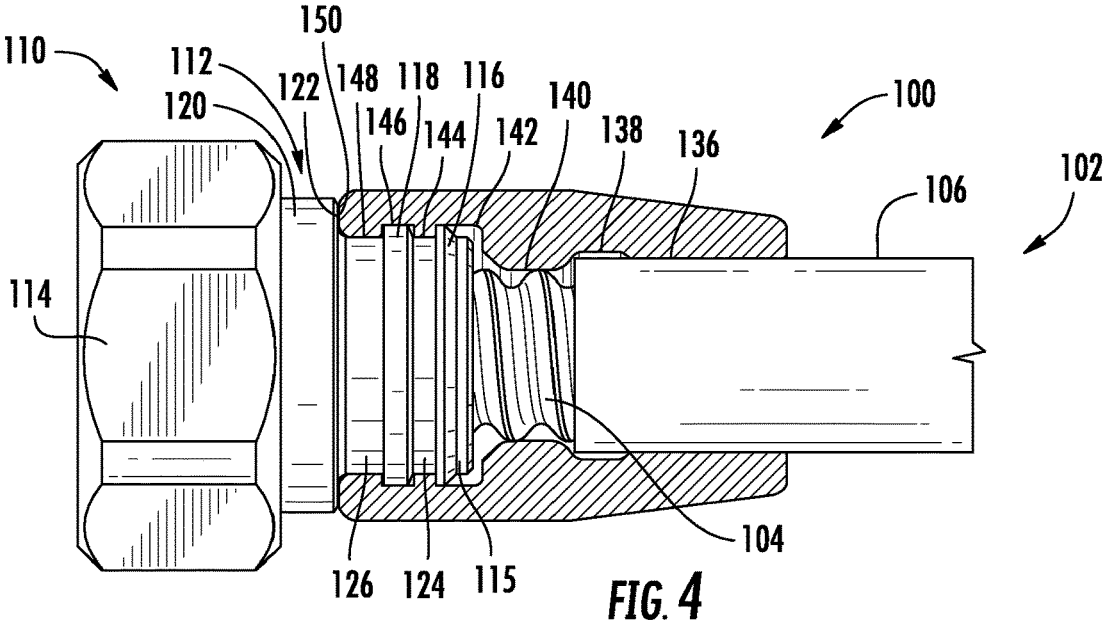
FIG. 4 is a section view of an assembly according to embodiments of the invention with the connector of FIG. 1 and the boot of FIG. 2.

Referring now to the drawings, a coaxial cable assembly according to embodiments of the invention is illustrated in FIGS. 1-4 and designated broadly at 100. The assembly 100 includes a coaxial cable 102 having an inner conductor (not shown), a dielectric layer overlying the inner conductor (also not shown), a corrugated outer conductor 104, and a jacket 106. As can be seen in FIG. 4, the jacket 106 is stripped away from the forward end of the cable 102, leaving the forward end of the cable 102 exposed.

Figure 5:
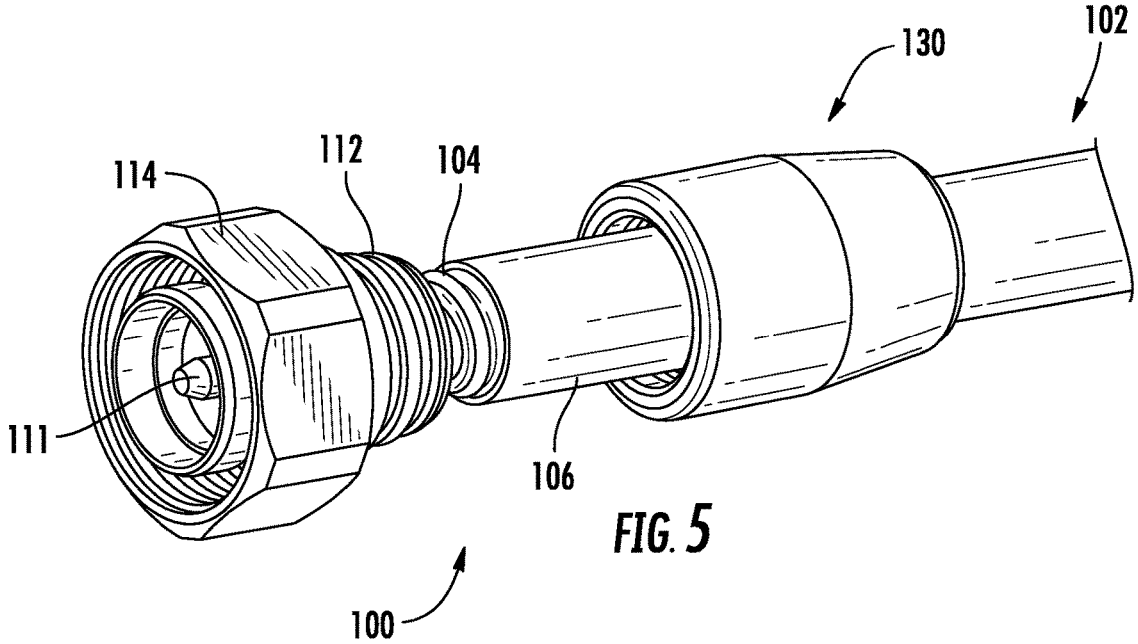
FIG. 5 is a perspective view of the assembly of FIG. 4 prior to installation of the boot over the rear end of the connector.

The assembly 100 also includes a coaxial connector 110 with an inner contact 111, an outer conductor body 112 and a coupling nut 114 (see FIGS. 1, 2 and 5). At its rearward end (i.e., the end nearest the cable 102), the outer conductor body 112 includes a guide ring 115, a sloped rearward ring 116, an intermediate ring 118 that is spaced forwardly from the sloped ring 116, and a forward ring 120 that is spaced forwardly from the intermediate ring 118 and that includes a forward shoulder 122. A first gap 124 is located between the sloped and intermediate rings 116, 118, and a second gap 126 is located between the intermediate ring 118 and the shoulder 122.

The assembly 100 also includes a protective boot 130 (see FIGS. 2-4). The boot 130 is generally cylindrical and hollow, with a bore 132 extending through the body 134 of the boot 130. The outer surface of the body 134 is tapered at its rearward end. The inner surface of the body 134 has multiple stepped features, such that the inner surface of the body 134 of the boot 130 varies in diameter in different sections. A cable sealing section 136 is present at the rearward end of the body 134. A concave relief section 138 merges with the cable sealing section 136 and, at its diametrically widest point, is larger than the cable sealing section 136. A convex outer conductor section 140 merges with the relief section 138 and, at its diametrically narrowest point, is smaller than the cable sealing section 136. A sloped ring section 142 merges with the outer conductor section 140 and has a larger inner diameter than the relief section 138. A first gap section 144 (in essence an annular ring that projects radially inwardly) is adjacent to and smaller in diameter than the sloped ring section 142. An intermediate ring section 146 is adjacent to the first gap section 144 and is similar in diameter to the sloped ring section 142. Finally, a second gap section 148 (also in essence an inwardly-extending ring) is adjacent to the intermediate ring section 146 and is similar in diameter to the first gap section 144. The second gap section 148 has a chamfered forward edge that merges with the forward surface 150 of the body 134.

Figure 6:
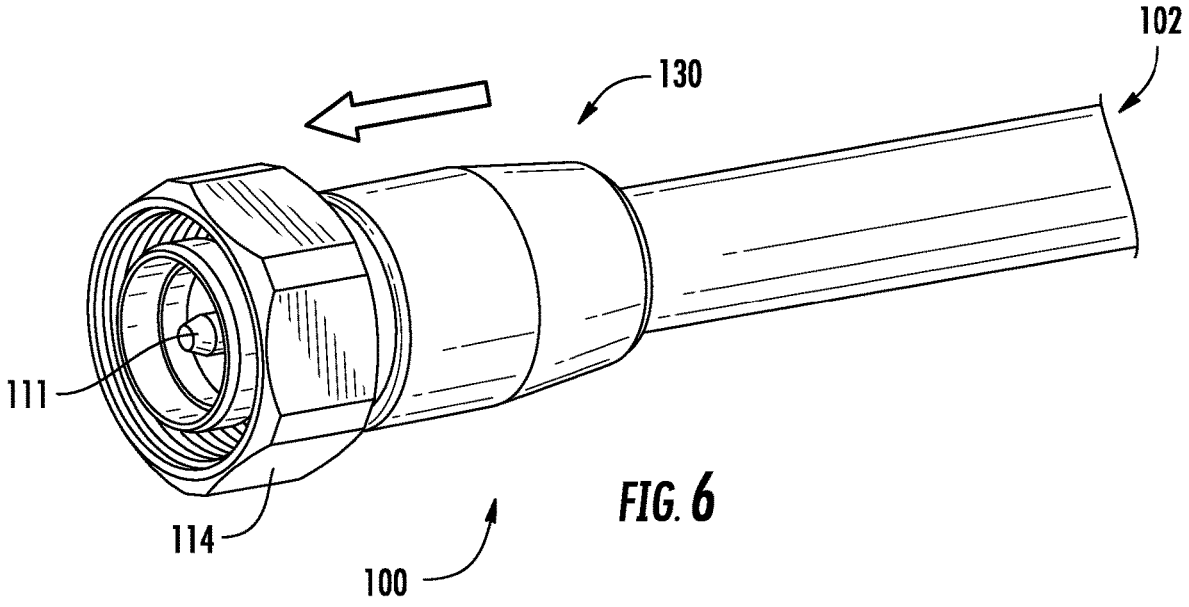
FIG. 6 is a perspective view of the assembly of FIG. 4 with the boot installed over the rear end of the connector.

FIGS. 5 and 6 illustrate the installation of the boot 130 on the connector 110. As can be envisioned with reference to FIG. 5, the boot 130 is installed on the cable 102 prior to the termination of the cable 102 with the connector 110. The connector 110 is then connected to the end of the cable 102 (i.e., the cable 102 is "terminated") via conventional means (e.g., crimping, soldering, etc.). As seen in FIGS. 4 and 5, even when the outer conductor body 112 and the outer conductor 104 are joined, a portion of the outer conductor 104 is exposed between the jacket 106 and the rear portion of the outer conductor body 112. As shown in FIG. 6, the boot 130 is then slid forward on the cable 102 to cover the rear portion of the outer conductor body 112 of the connector 110. Notably, installation of the boot 130 can be performed by a technician with just one hand.

As can be seen in FIG. 4, the various sections of the boot 130 overlie and/or capture features of the cable 102 and outer conductor body 112. More specifically, the cable sealing section 136 and the relief section 138 overlie the forward end of the cable jacket 106, with the front edge of the cable jacket 106 contacting a sloped section between the relief section 138 and the outer conductor section 140. The outer conductor section 140 overlies the outer conductor 104 of the cable. The sloped ring section 142 overlies the sloped ring 116, with the forward edge of the sloped ring 116 bearing against the rear edge of the first gap section 144. The first gap section 144 overlies the first gap 124. The intermediate ring 118 fits within the intermediate ring section 146, and the second gap section 148 overlies the second gap 126. The forward surface 150 of the body 134 bears against the shoulder 122. The presence of the first and second gap sections 144, 148 in the first and second gaps 124, 126 secures the boot 130 in place, thereby preventing unwanted axial movement of the boot 130 away from the connector 110.

It will be understood that the presence of the first and second gap sections 144, 148 within the first and second gaps 124, 126 secure the boot 130 in place over the connector 110 and cable 102. In addition, the cable sealing section 136 provides a seal between the cable jacket 106 and the boot 130, and interference fits between the first gap section, intermediate ring section and second gap section 144, 146, 148 and the first gap, intermediate ring and second gap 124, 118, 126 can provide seals between the boot 130 and outer conductor body 112, with the result that the joint between the coaxial cable 102 and the connector 110 is sealed from the environment. The guide ring 115, the sloped configuration of the sloped ring 116 and the chamfered edge of the second gap section 148 facilitate sliding of the boot 130 onto the connector 110. Also, the second gap section 148 is slightly larger in axial dimension than the first gap 124, which enables the second gap section 148 to slide over the first gap 124 rather than being captured therein during installation.

The boot 130 may be formed of a variety of materials that can be pre-molded and have high hardness, as this boot 130 is installed over the portions of the coaxial cable 102 and the connector 110 to provide sufficient protection for joint between the coaxial cable 102 and the connector 110. Exemplary materials include silicon rubber, hot melt adhesive or plastic.

Figure 7:
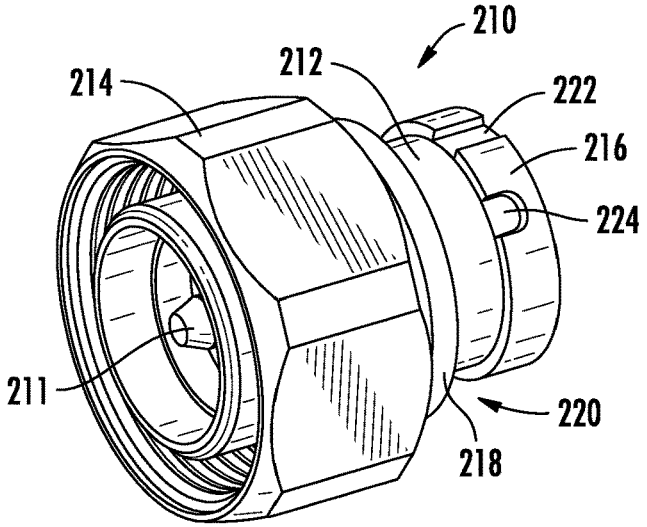
FIG. 7 is a perspective view of an exemplary connector for use in an assembly according to embodiments of the invention.

Referring now to FIGS. 7-12, another assembly according to embodiments of the invention, designated at 200, is shown therein. The assembly 200 includes a coaxial cable 202 that is very similar to the cable 102 discussed above. The assembly 200 also includes a connector 210 with an inner contact 211, an outer conductor body 212 and a coupling nut 214. At its rearward end, the outer conductor body 212 has a rear ring 216 and a forward ring 218 that sandwich a gap 220. As seen in FIG. 7, the rear ring 216 includes two diametrically opposed axial through-slots 222 (only one slot 222 is shown in FIG. 7), and also includes two diametrically opposed recesses 224 (only one recess 224 is shown in FIG. 7) that have a closed rear end and an open forward end.

Figure 8:
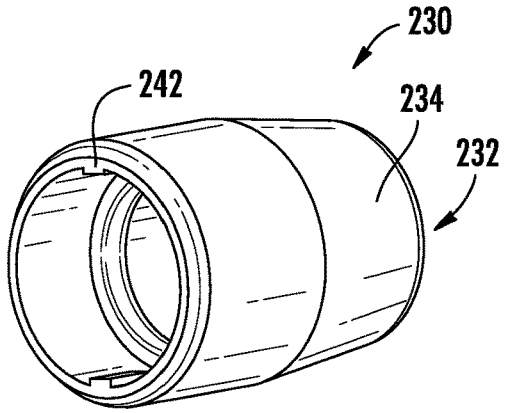
FIG. 8 is a perspective view of a protective boot for use in an assembly according to embodiments of the invention.
Figure 9:
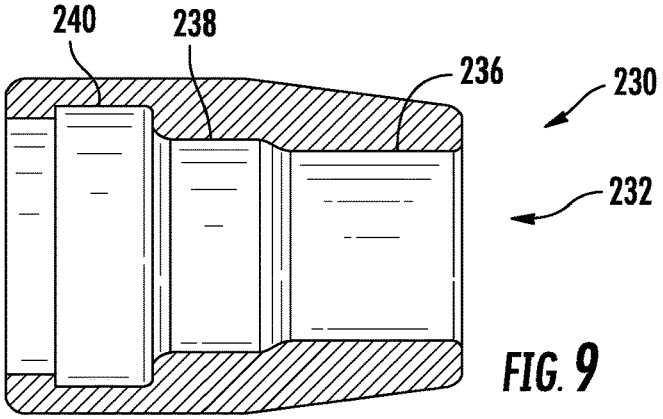
FIG. 9 is a section view of the boot of FIG. 8.
Figure 10:
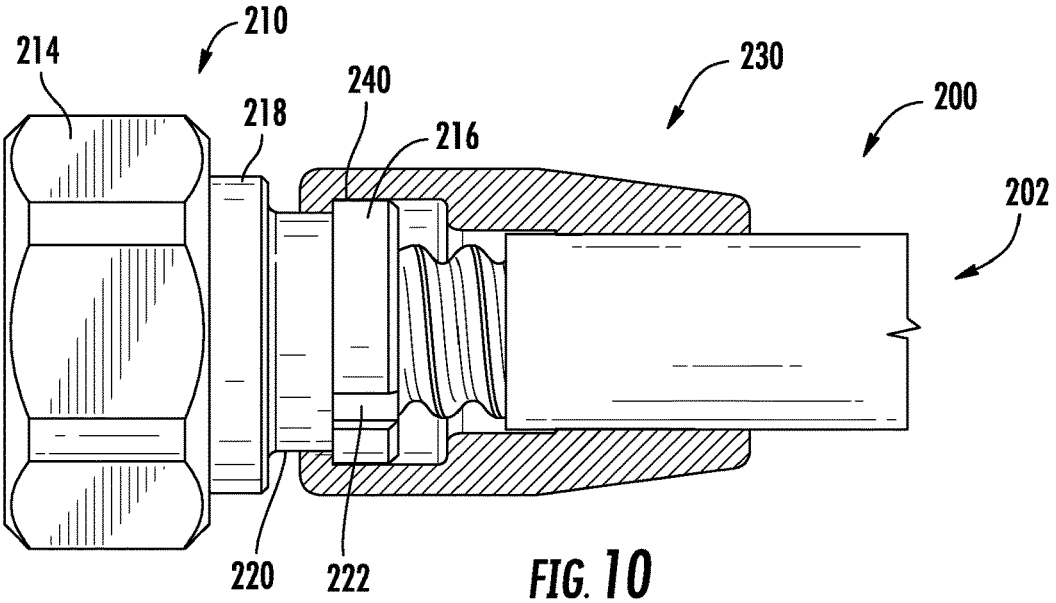
FIG. 10 is a section view of an assembly according to embodiments of the invention with the connector of FIG. 7 and the boot of FIG. 8.

Referring now to FIGS. 8-10, the assembly 200 further includes a boot 230 having a body 234 with a bore 232 therethrough. Like the boot 130, the inner surface of the body 234 has a stepped profile, with three main sections: a cable sealing section 236, a relief section 238 that has a larger inner diameter than the cable sealing section 236, and a connector section 240 that has a larger inner diameter than the relief section. Two diametrically opposed keys 242 extend radially inwardly from the forward end of the connector section 240.

Figure 11:
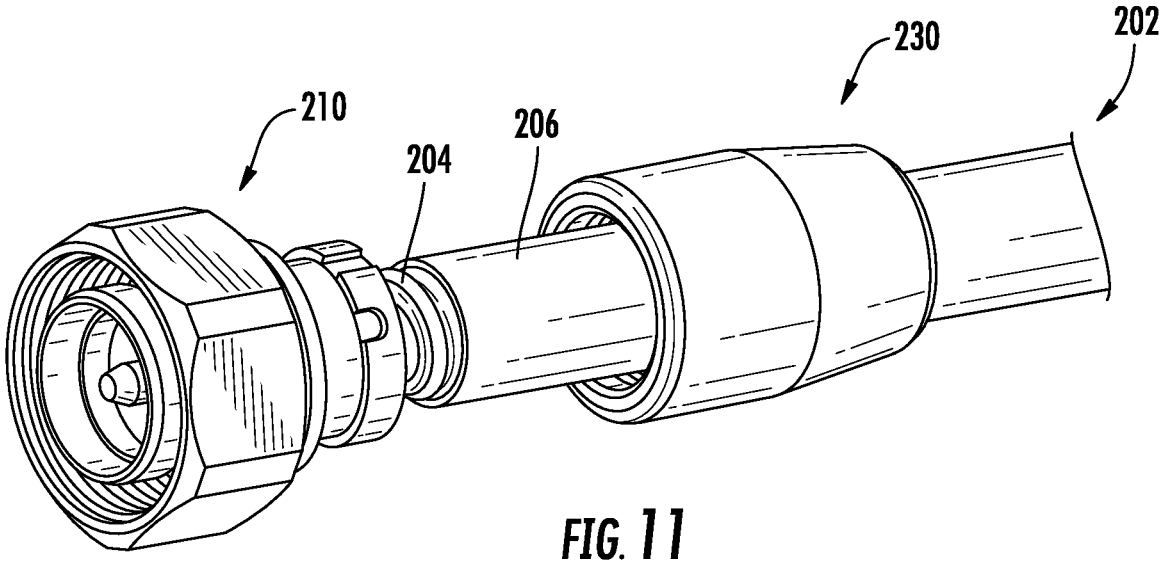
FIG. 11 is a perspective view of the assembly of FIG. 10 prior to installation of the boot over the rear end of the connector.
Figure 12:
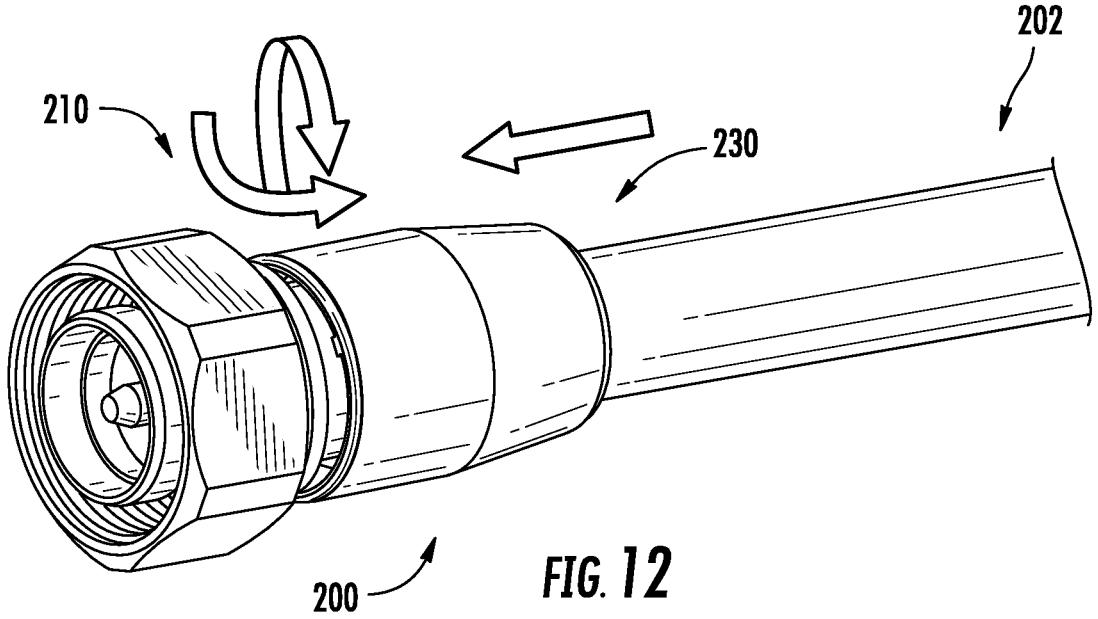
FIG. 12 is a perspective view of the assembly of FIG. 10 with the boot installed over the rear end of the connector.
Figure 13:
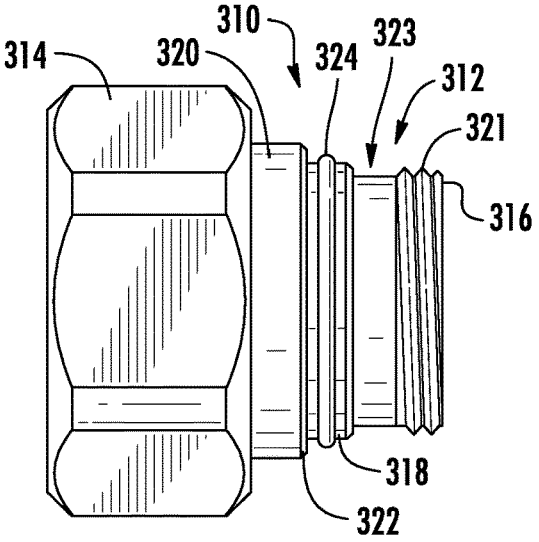
FIG. 13 is a side view of an exemplary connector for use in an assembly according to embodiments of the invention.
Figure 14:
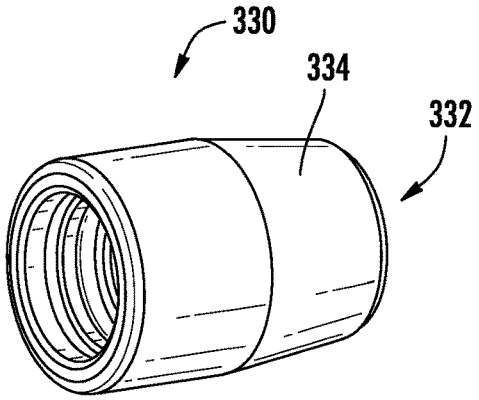
FIG. 14 is a perspective view of a protective boot for use in an assembly according to embodiments of the invention.
Figure 15:
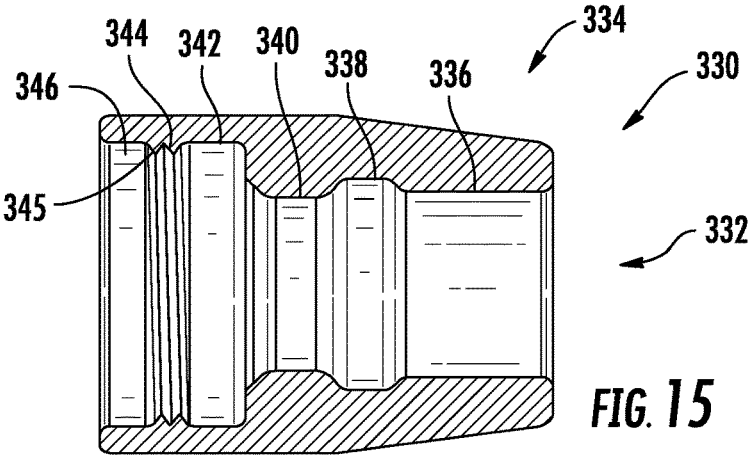
FIG. 15 is a section view of the boot of FIG. 14.
Figure 16:
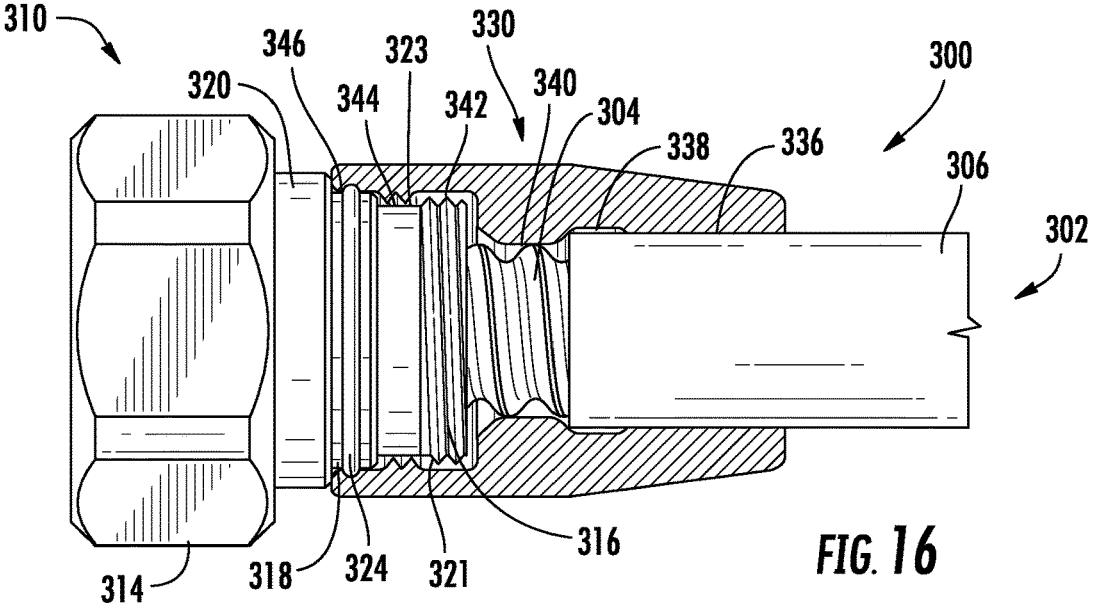
FIG. 16 is a section view of an assembly according to embodiments of the invention with the connector of FIG. 13 and the boot of FIG. 14.

Installation of the boot 230 on the connector 210 is illustrated in FIGS. 11 and 12. The cable 202 is inserted through the bore 232 of the boot 230 prior to the termination of the cable 202 with the connector 210. After the connector 210 has been attached, the boot 230 is rotated relative to the cable 202 so that the keys 242 align with the axial slots 222 in the rear ring 216 of the outer conductor body 212. The boot 230 is then slide forwardly along the cable 210 until the keys 242 pass through the axial through-slots 222. The boot 230 is then rotated about the axis of the cable 202 until the keys 242 align with the recesses 224, and then pulled rearwardly to seat the keys 242 in the recesses 224. The closed ends of the recesses 224 prevent unwanted axial movement of the boot 230 away from the connector 210. Also, as with the boot 130, the boot 230 can be installed by a technician using just one hand.

It should be noted that the gap 220 of the outer conductor body 212 should be at least as long (in the axial direction) as the keys 242, in order to allow the keys 242 to clear the rear ring 216 when sliding forwardly. The forward ring 218 may provide a forward stop for the boot 230 as it moves forward, thereby providing the technician with an indication that the keys 242 have cleared the rear ring 216 so that rotation can begin.

Referring now to FIGS. 13-18, another assembly according to embodiments of the invention, designated at 300, is shown therein. The assembly 300 includes a coaxial cable 302 that is very similar to the cables 102 and 202 discussed above. The assembly 300 also includes a connector 310 (FIG. 13) with an inner contact 311 (FIG. 17), an outer conductor body 312 and a coupling nut 314. Like the connector 110, the outer conductor body 312 of the connector 310 has a rear ring 316, an intermediate ring 318 (with a gap 323 therebetween) and a forward ring 320 that includes a forward shoulder 322. However, the intermediate ring 318 abuts the forward ring 320 such that there is no gap therebetween. Also, the rear ring 316 has a helical thread 321. An O-ring 324 encircles the intermediate ring 318.

The assembly 300 also includes a sealing boot 330 (FIGS. 14-16) that is rather similar to the boot 130, with a cable sealing section 336 present at the rearward end of the body 334 and merging concave relief, convex outer conductor, and ring sections 338, 340, 342. However, the boot 330 has only one gap section 344 and an intermediate ring section 346. Also, the gap section 344 includes a helical thread 345 that can mate with the thread 321 of the outer conductor body 312 of the connector 310.

Figure 17:
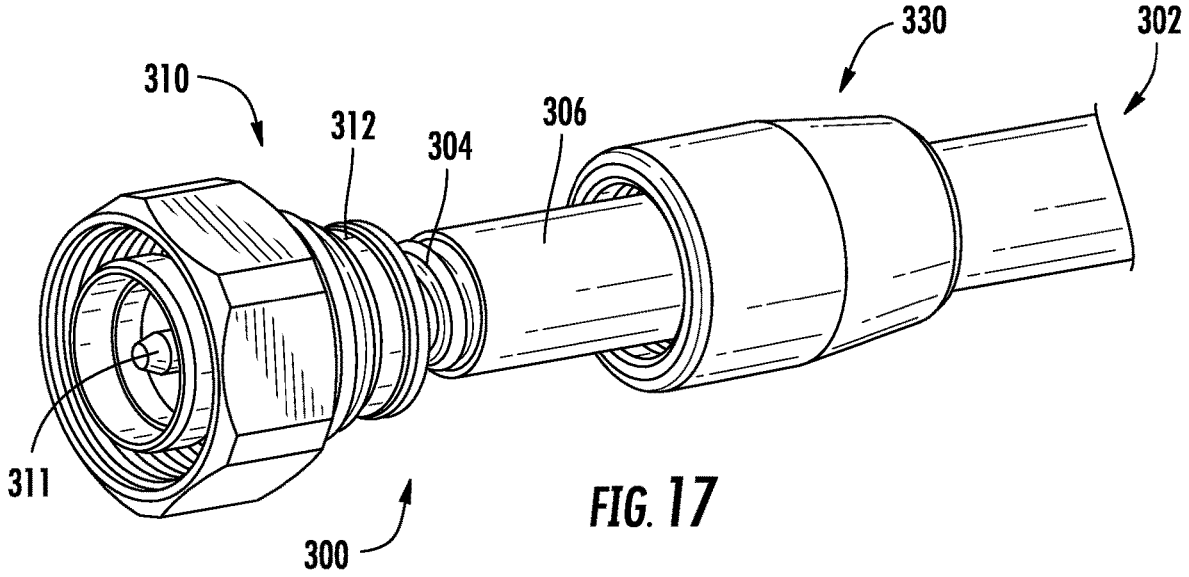
FIG. 17 is a perspective view of the assembly of FIG. 16 prior to installation of the boot over the rear end of the connector.
Figure 18:
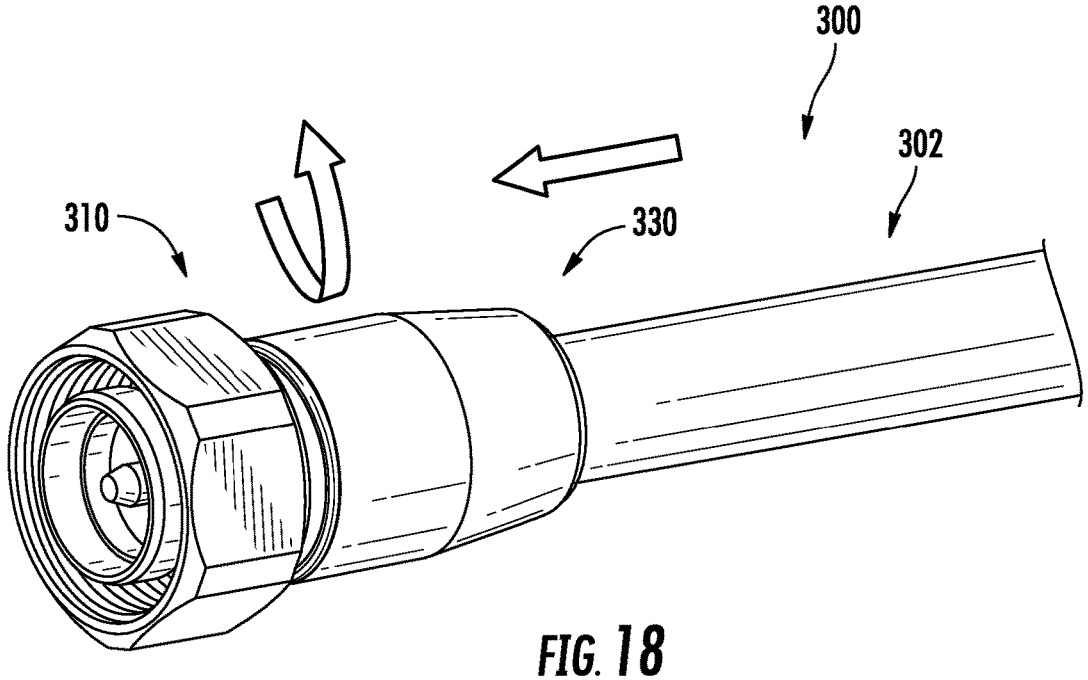
FIG. 18 is a perspective view of the assembly of FIG. 16 with the boot installed over the rear end of the connector.

Installation of the boot 330 on the connector 310 is illustrated in FIGS. 17 and 18. The cable 302 is inserted through the bore 332 of the boot 330 prior to the termination of the cable 302 with the connector 310. After the connector 310 has been attached, the boot 330 is then slide forwardly along the cable 310 until the thread 345 of the boot 330 meets the thread 321 of the connector 310. The boot 330 is rotated, with the threads 345, 321 meshing, until the thread 345 travels forwardly past the thread 321 and encircles the gap 323. The boot 330 stops against the forward shoulder 322 and retained by the thread 321 onto the outer conductor body 312 of the connector 310. The intermediate ring section 346 overlies the intermediate ring 318 and the O-ring 324.

The cable sealing section 336 provides a seal between the boot 330 and the cable jacket 306. The intermediate ring section 346 seals against the intermediate ring 318 of the outer conductor body 312 (assisted by the O-ring 324). Thus, the joint between the coaxial cable 302 and the connector 310 is protected from the environment. As with the boots 130, 230, the boot 330 may be installed using only one hand.

Those of skill in this art will appreciate that the assemblies according to embodiments of the invention may take other forms. For example, the connector may take different forms, including some that lack a coupling nut (e.g., push-on or quick-lock connectors) and/or some that may employ a back body in combination with an outer conductor body (as used herein, reference to an "outer conductor body" is intended to encompass the back body of a connector also). Although the boots 130, 230, 330 illustrate different features for securing the boots to the connectors, other features, such as discontinuous rings, ribs and the like, may also be employed, as may combinations of such features. The outer surface of the boots 130, 230, 330 may also vary as desired. Other forms will also be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An assembly, comprising:

a coaxial cable having an inner conductor, an outer conductor circumferentially surrounding and electrically insulated from the inner conductor, and a jacket overlying the outer conductor;

a coaxial connector having an inner contact and an outer conductor body circumferentially surrounding and electrically insulated from the inner contact, the outer conductor body having a rear portion electrically connected with the outer conductor of the coaxial cable to form a joint; and a protective boot that overlies a forward portion of the coaxial cable and the rear portion of the outer conductor body to protect the joint between the coaxial cable and the connector, the boot comprising a body with a bore extending therethrough, the body including a cable sealing section at one end that interference fits with the jacket of the cable to provide sufficient support for coaxial cable and create a first seal with the jacket of the cable, the boot further including one or more features within the bore that engage the outer conductor body forward of the electrical connection between the outer conductor and the outer conductor body to prevent axial movement of the boot relative to the cable and connector after installation of the boot, wherein the outer conductor body comprises a guide ring, a sloped ring, a first gap, an intermediate ring, and a second gap.

2. The assembly defined in claim 1, wherein the sloped ring and the intermediate ring secure the boot onto the outer conductor body and prevent axial movement of the boot relative to the cable and connector after installation of the boot.

3. The assembly defined in claim 2, wherein a sloped configuration of the sloped ring and the guide ring on the outer conductor body are configured to facilitate sliding of the boot onto the outer conductor body.

4. The assembly defined in claim 1, wherein the one or more features within the bore comprises a first gap section, an intermediate ring section and a second gap section that interference fits with the first gap, the intermediate ring and the second gap of the connector to provide a second seal between the outer conductor body and the boot, such that the first and second seals protect the joint between the coaxial cable and the connector from the environment.

5. The assembly defined in claim 4, wherein the second gap section is greater in axial length than the first gap.

6. The assembly defined in claim 1, wherein the protective boot comprises a moldable material with a high hardness selected from the group silicon rubber, hot melt adhesive and plastic.

7. The assembly defined in claim 6, wherein the boot is cylindrical and hollow or another desired profile.

8. The assembly defined in claim 1, wherein the one or more features within the bore comprises a first helical thread.

9. The assembly defined in claim 8, wherein the outer conductor body includes a second helical thread that is complimentary to the first helical thread of the boot.

10. The assembly defined in claim 9, wherein the first helical thread is positioned forwardly of the second helical thread when the boot is installed and blocked by the first helical thread onto the outer conductor body.

11. The assembly defined in claim 8, wherein the outer conductor body further comprising an O-ring that engages an inner surface of the bore forwardly of the first helical thread to form a second seal between the boot and the outer conductor body to protect the joint between the coaxial cable and the connector from the environment.

12. The assembly defined in claim 1, wherein the one or more features within the bore comprises a first annular section that fits within a first annular gap in the rear portion of the outer conductor body.

13. The assembly defined in claim 12, wherein the one or more features further comprises a second annular section that fits within a second annular gap in the rear portion of the outer conductor body.

14. An assembly, comprising:

a coaxial cable having an inner conductor, an outer conductor circumferentially surrounding and electrically insulated from the inner conductor, and a jacket overlying the outer conductor;

a coaxial connector having an inner contact and an outer conductor body circumferentially surrounding and electrically insulated from the inner contact, the outer conductor body having a rear portion electrically connected with the outer conductor of the coaxial cable to form a joint; and a protective boot that overlies a forward portion of the coaxial cable and the rear portion of the outer conductor body to protect the joint between the coaxial cable and the connector, the boot comprising a body with a bore extending therethrough, the body including a cable sealing section at one end that interference fits with the jacket of the cable to provide sufficient support for coaxial cable and create a first seal with the jacket of the cable, the boot further including one or more features within the bore that engage the outer conductor body forward of the electrical connection between the outer conductor and the outer conductor body to prevent axial movement of the boot relative to the cable and connector after installation of the boot, wherein the one or more features within the bore comprises a radially-inwardly protruding key that fits within a closed-end recess in a rear ring in of the outer conductor body.

15. The assembly defined in claim 14, wherein the outer conductor body further comprises an axial through-slot that enables the key to pass through the rear ring of the outer conductor body.

16. The assembly defined in claim 14, wherein the boot has at least two keys, and the outer connector body has at least two the axial through-slots.

17. A method of forming an assembly, comprising:

providing a coaxial cable having an inner conductor, an outer conductor circumferentially surrounding and electrically insulated from the inner conductor, and a jacket overlying the outer conductor;

installing a protective boot on the coaxial cable, the boot having a body with a bore extending therethrough, the body including a cable sealing section at one end that interference fits with the jacket of the cable to provide sufficient support for coaxial cable and creates a first seal with the jacket of the cable;

terminating the cable with a coaxial connector, the coaxial connector having an inner contact and an outer conductor body circumferentially surrounding and electrically insulated from the inner contact, the outer conductor body having a rear portion electrically connected with the outer conductor of the coaxial cable to form a joint and comprising a guide ring, a sloped ring, a first gap, an intermediate ring, and a second gap; and sliding the boot along the cable to overlie a rear portion of the outer conductor body, the boot further including one or more features within the bore that engage with the sloped ring and the intermediate ring of the outer conductor body forward of the electrical connection between the outer conductor and the outer conductor body to secure the boot on the outer conductor body and prevent axial movement of the boot relative to the cable and connector after installation of the boot.

18. The method defined in claim 17, wherein the one or more features within the bore comprises a radially-inwardly protruding key that fits within a closed-end recess in a rear ring of the outer conductor body, and wherein the outer conductor body further comprises an axial through-slot, and wherein sliding the boot along the cable includes sliding the key through the through-slot, and further comprising the steps of rotating the boot to align the key with the recess and sliding the boot rearwardly to engage the key in the recess.

19. The method defined in claim 17, wherein the one or more features within the bore comprises a first helical thread, wherein the outer conductor body includes a second helical thread that is complimentary to the first helical thread of the boot, and further comprising the step of rotating the boot relative to the outer conductor body, thereby enmeshing the first and second threads, the rotating step continuing until the first helical thread is positioned forwardly of the second helical thread and the boot is blocked by the first helical thread onto the outer conductor body.

* * * * *